US009446621B1

(12) United States Patent
Verret

(10) Patent No.: US 9,446,621 B1
(45) Date of Patent: Sep. 20, 2016

(54) GLOVE FOR DRY ERASE SURFACES

(71) Applicant: Steve Verret, Carlsbad, CA (US)

(72) Inventor: Steve Verret, Carlsbad, CA (US)

( * ) Notice: Subject to any disclaimer, the term of this patent is extended or adjusted under 35 U.S.C. 154(b) by 0 days.

(21) Appl. No.: 14/336,943

(22) Filed: Jul. 21, 2014

Related U.S. Application Data

(60) Provisional application No. 61/856,415, filed on Jul. 19, 2013.

(51) Int. Cl.

| | |
|---|---|
| ***A46B 5/04*** | (2006.01) |
| ***B43L 19/00*** | (2006.01) |
| ***A41D 19/00*** | (2006.01) |
| ***A47L 13/18*** | (2006.01) |
| ***B43L 21/00*** | (2006.01) |
| ***B43L 21/04*** | (2006.01) |

(52) U.S. Cl.
CPC ..... *B43L 19/005* (2013.01); *A41D 19/0024* (2013.01); *A47L 13/18* (2013.01); *B43L 21/00* (2013.01); *B43L 21/04* (2013.01)

(58) Field of Classification Search
CPC ..... A47L 13/18; B43L 19/005; B43L 21/00; B43L 21/04
See application file for complete search history.

(56) References Cited

U.S. PATENT DOCUMENTS 7,861,353 B2 * 1/2011 Lewis ..... A41D 19/01594 15/104.002
2006/0150356 A1 * 7/2006 Tayler ..... A47L 13/18 15/227

FOREIGN PATENT DOCUMENTS

CN 201922787 U * 8/2011
KR 20110004965 U * 5/2011

* cited by examiner

*Primary Examiner* — Jennifer C Chiang
(74) *Attorney, Agent, or Firm* — San Diego IP Law Group LLP

(57) ABSTRACT

A glove or mitten, worn on the non-writing hand, in which a set of erasers is disposed on the palm and fingers of the glove and one or more writing instruments (e.g., whiteboard markers) are disposed on the back of the hand. Instead of continuously holding onto an eraser while writing, the set of erasers allow the user to easily erase markings on the board. The glove can hold a number, e.g., four, markers on the back the hand. The user can easily retrieve the markers while writing on the dry erase surface.

3 Claims, 2 Drawing Sheets

GLOVE FOR DRY ERASE SURFACES

CROSS-REFERENCE TO RELATED APPLICATION

The present application claims priority to U.S. Provisional Patent Application No. 61/856,415, filed on Jul. 19, 2013, entitled "Teacher's Helper," the entire disclosure of which is incorporated by reference herein.

BACKGROUND OF THE INVENTION

1. Field of Invention

This invention relates to a glove for dry erase surfaces and workboards.

2. Description of Related Art

Dry-erase boards (or "whiteboards") are commonly used in school lectures, corporate meetings, or any sort of presentation. Presenters can waste time when reaching for an eraser or marker on the marker tray. If a wide dry-erase board is used, the presenter would have to take the time to walk to where the eraser or marker is located. Erasers and markers are essential for presentations and to correct any errors or change what was previously drawn, or to switch color or another marker if ink runs out. Reaching for an eraser or marker can disrupt the flow of the presentation, which not only burden the audience, but cut down on the presentation time.

SUMMARY OF THE INVENTION

The present invention overcomes these and other deficiencies of the prior art by providing a glove or mitten, worn on the non-writing hand, in which a set of erasers is disposed on the palm and fingers of the glove (or finger section in case of a mitten) and one or more writing instruments (e.g., whiteboard markers) are disposed on the back of the hand. The glove can hold a number, e.g., four, markers on the back the hand. The user can easily retrieve the markers while writing by easily bringing up the non-writing hand to the writing hand.

A glove for dry erase surfaces, the glove comprising: a covering comprising a thumb section and four finger sections, the covering having a back side and a front side; on the back side of the covering, a means for securing a dry erase writing instrument to each of the four finger sections; and on the front side of the covering, an eraser attached to each of the four finger sections and the thumb section. The glove further comprising an eraser attached to a palm area of the front side of the covering.

In another embodiment of the invention, a glove for dry erase surfaces, the glove comprising: a covering comprising a thumb section and a finger section for all four fingers of a hand, the covering having a back side and a front side; on the back side of the covering, a means for securing a plurality of dry erase writing instruments to the finger section; and on the front side of the covering, an first eraser attached to the finger section and a second eraser attached to the thumb section. The glove may further comprise a third eraser attached to a palm area of the front side of the covering.

The foregoing, and other features and advantages of the invention, will be apparent from the following, more particular description of the preferred embodiments of the invention, the accompanying drawings, and the claims.

BRIEF DESCRIPTION OF THE DRAWINGS

For a more complete understanding of the present invention, the objects and advantages thereof, reference is now made to the ensuing descriptions taken in connection with the accompanying drawings briefly described as follows.

DETAILED DESCRIPTION OF PREFERRED EMBODIMENTS

Figure 1:
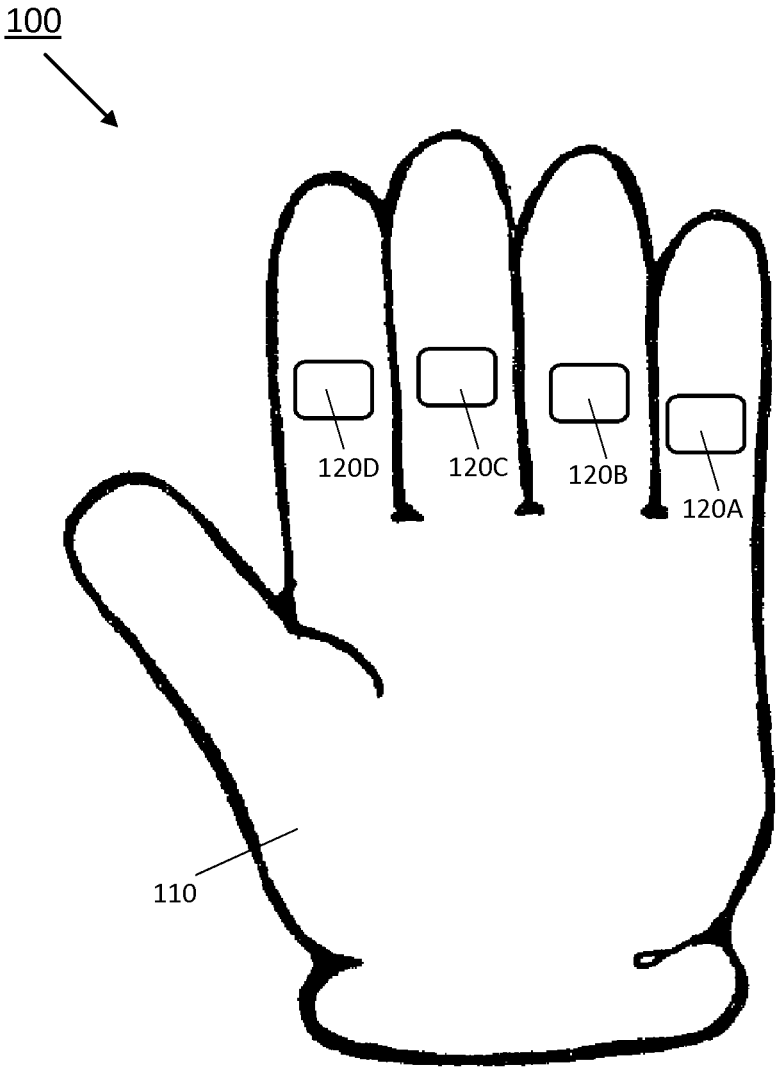
FIG. 1 illustrates the backside of a glove for dry erase surfaces according to an embodiment of the invention.
Figure 2:
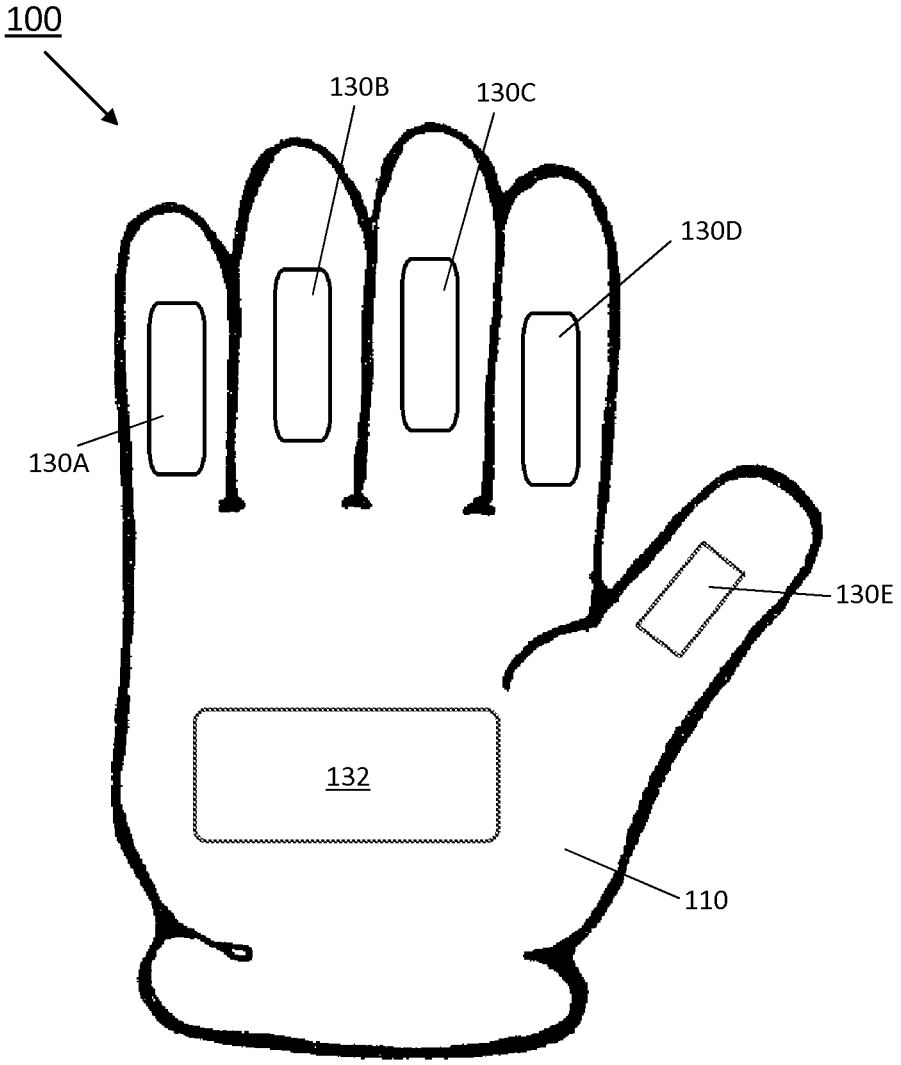
FIG. 2 illustrates the frontside of a glove for dry erase surfaces according to an embodiment of the invention.

Preferred embodiments of the present invention and their advantages may be understood by referring to FIG. 1 and FIG. 2, wherein like reference numerals refer to like elements.

FIG. 1 and FIG. 2 illustrates a glove 100 for dry erase surfaces according to an embodiment of the invention. FIG. 1 illustrates the backside of the glove (i.e., the backhand) and FIG. 2 illustrates the frontside of the glove (i.e., the palm) for a left-handed writer—glove 100 would be placed on the writer's right hand.

Referring to FIG. 1, the glove 100 comprises a covering 110 configured for the right hand with separate parts for each finger and the thumb. Alternatively, the covering 110 is configured for the left hand (not shown) with separate parts for each finger and the thumb. Securing means 120A-D are provided to secure a writing instrument such as, but not limited to a dry erase marker to each finger. In an embodiment of the invention, securing means 120A-D comprise Velcro, with one strip stitched or glued to a respective finger and with the other strip fastened to the marker via glue, tape, or any alternative fastener. In another embodiment of the invention, securing means 120A-D comprise an elastic loop stitched or glued to a respective finger. A marker is inserted into the elastic loop and the elasticity of the loop prevents the marker from moving. In another embodiment of the invention, securing means 120A-D comprise a fabric or plastic pocket stitched or glued to a respective finger by which a marker can be snugly inserted. In another embodiment of the invention, securing means 120A-D comprise a magnet stitched or glued to a respective finger by which a magnetic marker can be attached. In another embodiment of the invention, securing means 120A-D comprise a metal or plastic clip stitched or glued to each respective finger by which a marker can be held in place in the clip. Optionally, an additional securing means (not shown) can be disposed on the thumb.

Referring to FIG. 2, the covering 110 comprises dry erase board erasers 130A-E. In an embodiment of the invention, each one of the erasers 130A-E is a strip of felt placed along a length of the thumb and each finger as shown. An optional eraser 132 comprises felt and is placed on the palm. The erasers 130A-E and 132 are stitched or glued to the covering 110. Alternatively, erasers 130A-E and 132 may be formed as a single hand-shaped piece of felt. However, strips of felt are preferable as they provide greater flexibility in hand movement when using the glove 100. The erasers 130A-E travel along the entire length of the thumb and each respective finger.

In an embodiment of the invention, the tips of the fingers and thumb are removed from covering 110.

In an alternative embodiment of the invention, the covering 110 is a mitten with two sections, one for the thumb and the other for all four fingers. The securing means 120A-D are disposed on the section for all four fingers. Optionally, an additional securing means (not shown) can be disposed on the thumb.

The invention has been described herein using specific embodiments for the purposes of illustration only. It will be readily apparent to one of ordinary skill in the art, however, that the principles of the invention can be embodied in other ways. Therefore, the invention should not be regarded as being limited in scope to the specific embodiments disclosed herein, but instead as being fully commensurate in scope with the following claims.

I claim:

1. A glove for dry erase surfaces, the glove comprising:

a covering comprising a thumb section, a palm section, and four finger sections, the covering having a back side and a front side;

on the back side of the covering, a means for securing a dry erase writing instrument to each of the four finger sections; and on the front side of the covering, a first eraser attached to the thumb section;

a second eraser attached a first finger section of the four finger sections;

a third eraser attached to a second finger section of the four finger sections;

a fourth eraser attached to a third finger section of the four finger sections;

a fifth eraser attached to a fourth finger section of the four finger sections; and a sixth eraser attached to the palm section, wherein the first eraser, second eraser, third eraser, fourth eraser, and fifth eraser each comprise a strip of felt disposed along an entire length of the respective thumb section or finger section, and the glove is configured to be worn on a non-writing hand of a user.

2. The glove of claim 1, wherein the first eraser, second eraser, third eraser, fourth eraser, fifth eraser, and sixth eraser are separate erasers.

3. The glove of claim 1, wherein a tip is removed from each of the thumb section and the four finger sections.

* * * * *